United States Patent [19]

White

[11] 3,984,106

[45] Oct. 5, 1976

[54] GAME APPARATUS

[76] Inventor: Maud Verral White, 45 Livingston Road, Apt. No. 1010, Scarborough, Ontario, Canada, M1E 1K8

[22] Filed: July 31, 1974

[21] Appl. No.: 493,416

[52] U.S. Cl. ..... 273/134 AB; 273/130 E; 273/135 D

[51] Int. Cl.[2] ..... A63F 3/00

[58] Field of Search ..... 273/130, 134, 135

[56] References Cited

UNITED STATES PATENTS

| | | | |
|---|---|---|---|
| 1,055,151 | 3/1913 | Emerson | 273/130 E UX |
| 2,177,078 | 10/1939 | Raizen et al. | 273/134 C |
| 2,380,106 | 7/1945 | Hilton | 273/135 D |
| 3,606,336 | 9/1971 | Krause | 273/135 D |
| 3,749,404 | 7/1973 | Oetzel | 273/135 B |
| 3,831,946 | 8/1974 | Denalsky | 273/134 AD |

*Primary Examiner*—Delbert B. Lowe
*Attorney, Agent, or Firm*—J. Noel Walton

[57] ABSTRACT

A word-forming game comprises a playing board having printed thereon a track divided into a plurality of playing squares, on each of which there is printed a number or letter. A playing piece or token is moved along the track in response to the roll of one or more dice. The character appearing in the square onto which the token is moved then indicates either the starting letter of a word to be formed by the player or the number of letters in such a word. In the former case, the number of letters in the word can be determined by the existing indication of the dice, by a second roll of the dice or by a number printed on the top card of a deck of cards having numbers randomly printed thereon. When the playing squares have numbers printed thereon, the word-starting letter to be used can similarly be determined using a deck of cards, each of which bears a letter.

3 Claims, 9 Drawing Figures

GAME APPARATUS

BACKGROUND OF THE INVENTION

The present invention relates generally to a game apparatus and more particularly to a word-forming game apparatus.

Various word-forming games have heretofore been proposed but many of the previously proposed games have presented disadvantages of one kind or another. For example, some of the previously proposed games have had relatively complex rules while others have been very limited in their utility. For instance, some of the known games constructed so as to be suitable to be played by children were unsuitable for playing by adults, and vice-versa.

It is a principal object of this invention to provide a word-forming game which is extremely simple in its construction but highly versatile in its utility.

More particularly, it is an important object of this invention in accordance with a preferred feature thereof to provide a word-forming game which can be constructed in such a way that its rules can be varied so that it can be played not only by adults but even by very young children, without any loss to either group of the underlying challenge of the game.

Other objects of the invention will become apparent as the description herein proceeds.

SUMMARY OF THE INVENTION

Broadly, a game apparatus in accordance with this invention can be defined as comprising a playing board having provided thereon a track divided into a sequence of playing zones, characters randomly selected from a first set of characters being provided on said board in association with respective ones of said playing zones; a playing piece for movement by a player along said track; first indicating means for randomly indicating the number of zones of said track over which the playing piece should be moved by the player; and second indicating means for indicating a character randomly selected from a second set of characters, the characters of one of said sets being alphabetical and the characters of the other of said sets being numerical.

The first indicating means of a game apparatus in accordance with this invention can take many forms. It can, for example, be a single die or two or more dice. Alternatively, a spinner of the type often used in other games can be used to indicate the number of playing zones or squares over which a player's playing piece is to be moved. Having moved his playing piece, a player then notes the character printed or otherwise provided on the square on which his playing piece comes to rest. Where that character is a cardinal number, that number represents the number of letters in the word to be formed by the player. When it is a letter, it indicates the initial letter of the word to be formed by the player. Having so identified either the initial letter of the word which he must form or the number of letters in such a word, the player then utilizes the game apparatus to determine the other of those two requirements. For example, if he has so determined the initial letter, he can then utilize the existing die or dice roll indication to determine the number of letters in the word which he must form. Alternatively, he can re-roll the die or dice or again spin a spinner to determine the number of letters in the word which he must form. Yet another possibility within the scope of this invention is for the player to draw a card from a deck of cards and to note the number printed on the actual card which he draws, such number again indicating the number of letters in the word which he must form.

In the case where the characters provided in the playing squares are numerical, the player first notes the number shown on the square onto which his playing piece is moved, such number indicating the number of letters in the word which he must form; he then operates the second indicating means to determine the initial letter of such word. Such initial letter determination can, for example, be made by the player drawing a card from a deck of cards, each of which has an alphabetical character printed thereon.

The letters which a player may use to form a word when playing a game provided by this invention can be determined in many different ways. In its simplest form, the rules for such a game may provide that the player is free to use any letters he wishes provided that the word commences with the initial letter indicated by the game apparatus and additionally that it contains the indicated number of letters. In this very simple form, the game is especially suited for young children.

In a slightly less simple form, the player may be required to form a word using the letters of a single word which has been selected before the game is commenced or using the letters of a word revealed to the player as he plays the game. For example, when the game apparatus comprises a deck of cards bearing individual alphabetical or numerical characters as already described, each such card may also carry a word, the letters of which the player must use in forming a word. Similarly, the individual playing squares on the playing board may be provided with words for the same purpose.

Other features of the invention will become apparent as the description herein proceeds.

BRIEF DESCRIPTION OF THE DRAWINGS

The invention will now be described merely by way of illustration with reference to the accompanying drawings in which.

DESCRIPTION OF THE PREFERRED EMBODIMENTS

Figure 1:
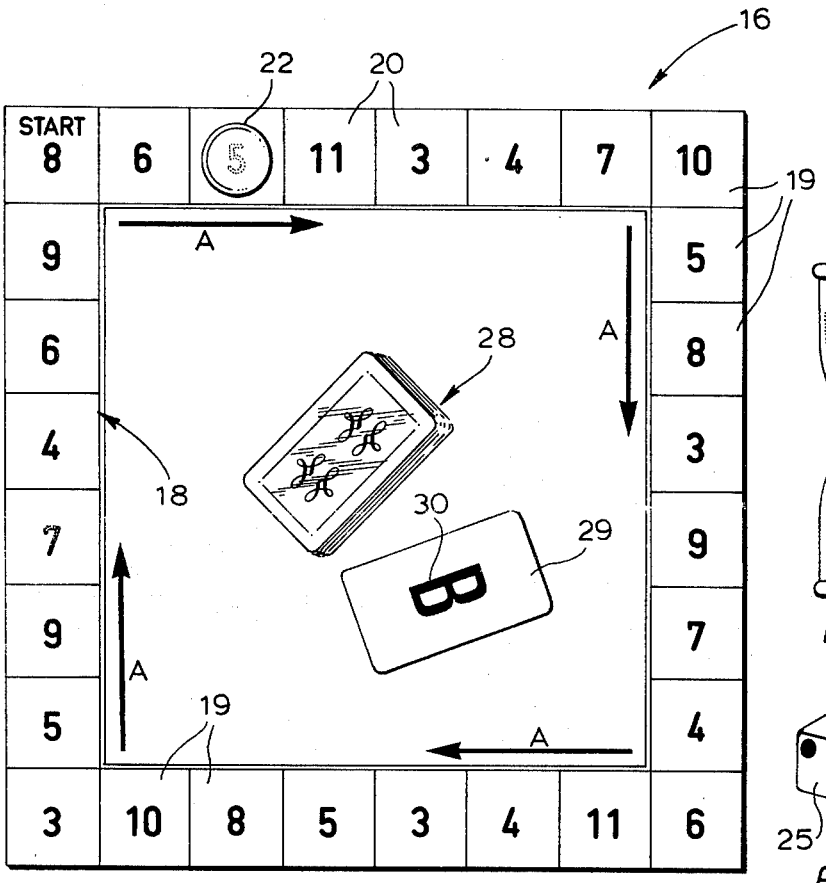
FIG. 1 is a plan view of a game board and of a deck of cards forming part of one embodiment of a game apparatus in accordance with this invention.

Reference will first be made to FIG. 1 of the accompanying drawings in which there is indicated generally at 16 a playing board having a peripheral track generally indicated at 18 printed thereon. The track 18 is divided into a plurality of playing zones or squares 19. It must be understood that, when reference is made herein to playing "squares," limitation to playing zones which are actually square in shape is, of course, not intended.

It will be noted from FIG. 1 that each of the playing squares 19 has printed therein a number indicated at 20. The or each player is provided with a playing piece or token such as the token indicated at 22 which is moved along the track 18 as indicated by the arrows A in a manner yet to be explained. The game board 16 in FIG. 1 is used together with a pair of conventional dice 25 and 26 as shown in FIG. 2 and also has provided thereon a deck generally indicated at 28 of cards, one card of which is indicated at 29 and on each of which is printed a letter as indicated at 30, such as the letter B shown in FIG. 1 on the particular card 29.

Figure 2:
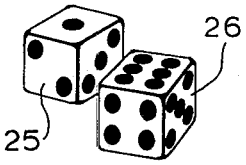
FIG. 2 is a perspective view of a pair of dice forming a further part of the same embodiment of the invention as shown in FIG. 1.

In playing the game using the game apparatus shown in FIGS. 1 and 2, a player first places his token 22 on the "START" position, rolls the dice 25 and 26 and then moves his token 22 the number of squares indicated by the dice. He then notes the number printed on the square onto which his token is moved. Assuming, for example, that his token 22, after several plays, comes to rest on the square carrying the number "5" as actually shown in FIG. 1, the player then knows that he must form a word of five letters.

The player next draws a card from the deck 28 and turns that card face upward to reveal the particular letter printed thereon. Assuming that he turns up the card 29 to reveal the letter B printed thereon, the player then knows that he must form a five letter word starting with the letter B.

In the simplest form of the game, the rules may place no other requirements on the player. This simple game might well present sufficient challenge to young children but, for older children or adults, the player might, for example, be required to form the word using the letters of a word selected before the commencement of the game. With such a rule it would, of course, generally be desirable to remove from the deck 28 those cards which bear letters which do not occur in such a preselected word.

Figure 3:
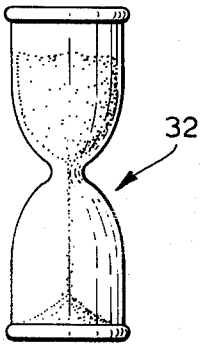
FIG. 3 is a front elevation of a timing device for use with the game apparatus shown in FIGS. 1 and 2.

Yet another possibility for governing the play of the game hereinbefore specifically described is to provide a timer to permit the requirement that the player form a word in a given time. One typical timer for such a purpose and of the known "hour-glass" type is indicated at 32 in FIG. 3.

Although only one token 22 is shown in FIG. 1, it will be understood that the game apparatus shown in FIGS. 1 and 2 can be used by any number of players.

Figure 4:
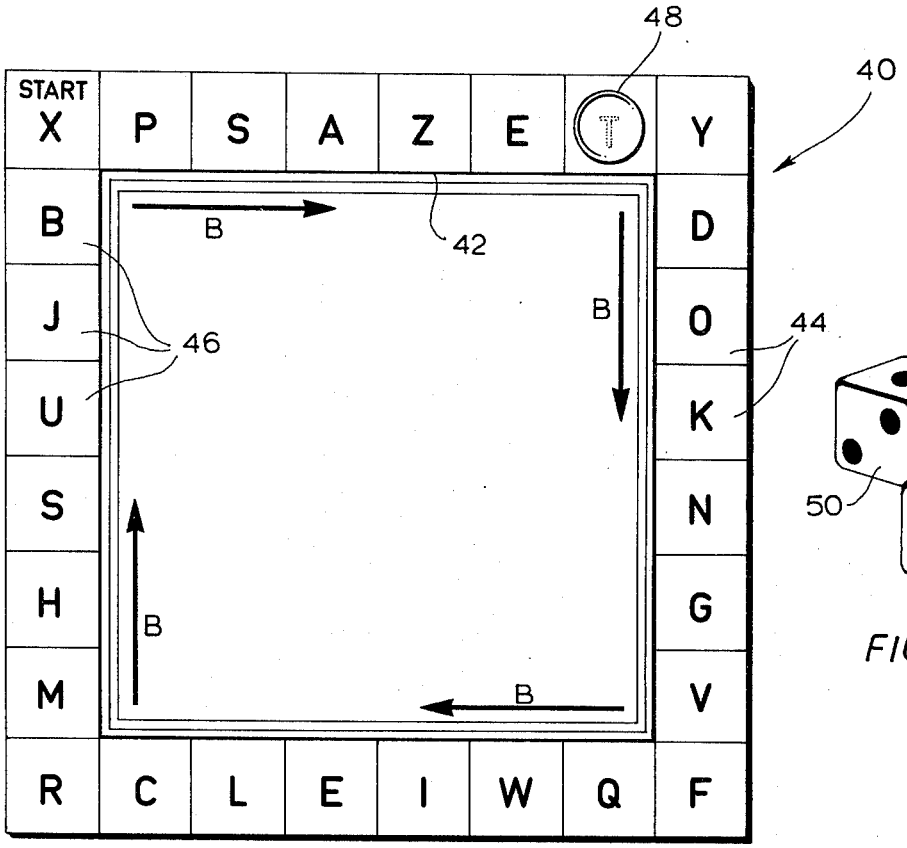
FIG. 4 is a plan view of a game board forming part of an alternative embodiment of a game apparatus in accordance with this invention.

Reference will now be made to FIG. 4 in which there is shown generally at 40 a playing board forming part of an alternative embodiment of a game apparatus in accordance with this invention. The playing board 40 has printed thereon a peripheral track 42 comprising a plurality of playing zones or squares 44, in each of which there is printed a letter as indicated at 46. In use, a token such as the token indicated at 48 is moved by the player around the track 42 as indicated by the arrows B, the letter printed in the square on which the player's token lands then being the initial letter of the word which the player must form. For example, if, as shown in FIG. 4, the player's token 48 lands on the square having printed therein the letter T, he must then form a word commencing with the letter T.

Figure 5:
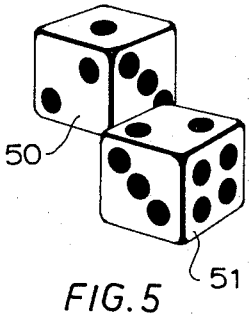
FIG. 5 is a perspective view of a particularly useful pair of dice for use in conjunction with the game board shown in FIG. 4.
Figure 6:
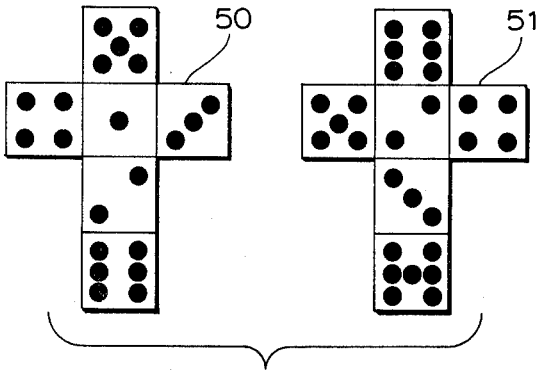
FIG. 6 is a planar development of the dice shown in FIG. 5.

The movement of the token 48 around the track 42 can be determined by any random number-indicating device such as one or more conventional dice. There is, shown in FIGS. 5 and 6 a pair of dice 50 and 51 which present certain advantages for use in association with the game board 40. The die 50 is conventional, having pips representing the numbers "1" through "6" printed thereon in their normal positions. The die 51 differs, however, in that it has pips representing the numbers "2" through "7" printed thereon in the orientation shown in developed form in FIG. 6. By rolling the dice 50 and 51, the player determines how many squares he should move his token 48 along the track 42. The total of the two numbers shown by the dice can also determine the number of letters in the word to be formed by the player. For example, if the player rolls the dice 50 and 51 and the numbers "3" and 7 face upwardly, the player first moves his token 10 places, notes the initial letter printed on the square 44 on which he lands and then knows that he must form a 10 letter word commencing with that letter. Alternatively, the rules may provide that the player must make a second throw of one or both of the dice 50 and 51 in order to determine the number of letters in the word which he must form.

As already described with reference to the embodiment of the game apparatus as shown in FIGS. 1 and 2, a player using the game board 40 shown in FIG. 4 may be permitted to form a word from any letters or using only the letters of a preselected word.

One important advantage of the dice 50 and 51 is that the lowest possible total "throw" using both dice is 3 so avoiding the somewhat over simple possibility of allowing an adult player to form a two letter word. When children play the game, only the die 51 is used and, since the lowest number on that die is 2, the possible forming of a one letter word is consequently avoided. It will now be understood that, by deciding whether both the dice 50 and 51 are to be rolled or that only the die 51 is to be rolled, the complexity of the game can be varied so that it is simple enough for young children or sufficiently challenging for adults.

Figure 7:
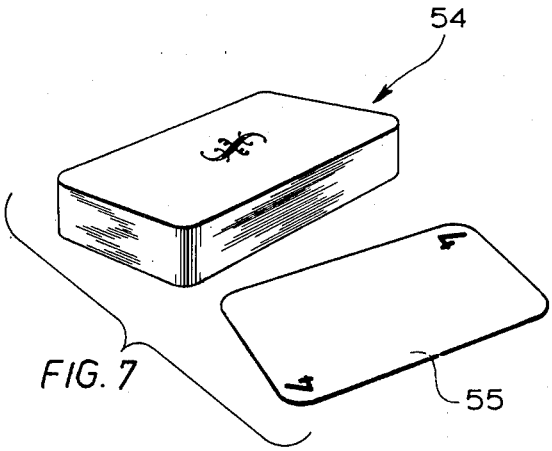
FIG. 7 is a perspective view of a deck of cards intended for use with the game board shown in FIG. 4.

Instead of using the dice 50 and 51 to determine the length of the word to be formed, the game board 40 shown in FIG. 4 can be used together with the deck of cards generally indicated at 54 in FIG. 7. Each of the cards of the deck 54 has a number printed thereon. For example, the card indicated at 55 in FIG. 7 has the number "4" printed thereon. When such cards are provided, the game board 40 can be used together with at least one conventional die. The player first rolls the die or dice and then moves his token 48 the indicated number of squares, the square on which his token comes to rest then indicating the initial letter of the word which he must form. He then takes the top card from the deck 54 to determine the number of letters in the word which he must form. For example, if he takes the card 55, he will then know that the word which he must form must contain four letters.

An important advantage resulting from the use of a deck of number-bearing cards such as the deck 54 is that those cards carrying higher numbers can be removed from the deck if the game is to be played by children. In fact, simply by deciding which cards are to be used, the game can be tailor-made for players of every desired degree of literacy.

Figure 8:
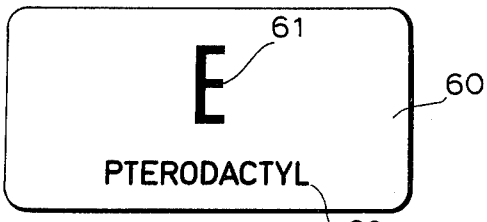
FIG. 8 is a plan view of one card of an alternative deck of cards for use with the playing board shown in FIG. 1.

In FIG. 8, there is shown a single card 60 of an alternative deck of cards for use with the game board shown in FIG. 1. In addition to the initial letter E printed thereon as indicated at 61, the card 60 also has printed thereon a word or sequence of letters 62, the letters of which the player is free to use in forming his word. It will be understood that different words can be printed on different cards of such a deck.

Figure 9:
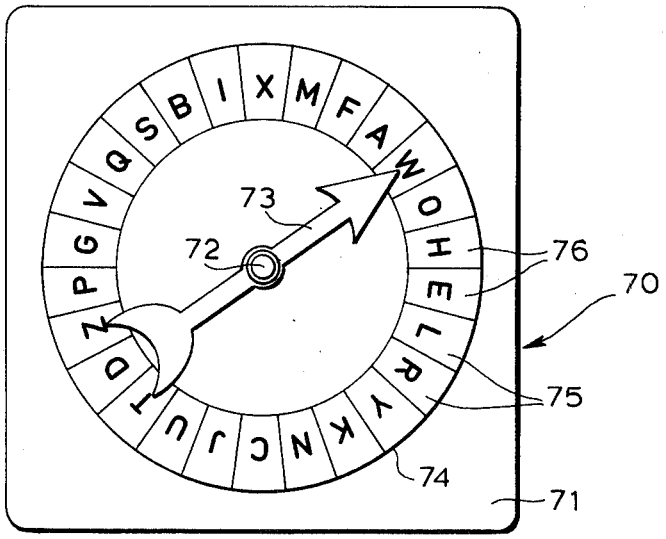
FIG. 9 is a plan view of a spinning device for use in conjunction with the game board shown in FIG. 1.

Finally reference is made to FIG. 9 which shows generally at 70 a spinner device of conventional construction and which may form part of the game apparatus in accordance with this invention. Spinner 70 comprises a base 71 on which there is pivotally mounted at 72 a pointer 73. A circular track 74 divided into "squares" 75 is printed on the base 71 and letters 76 are randomly printed in the squares 75.

For use with the game board shown in FIG. 1, the player first rolls the dice 25 and 26 and moves his token 22 the indicated number of squares so identifying from the square on which he lands the number of letters in the word which he must form. He then spins the pointer 73 and notes the initial letter 76 printed adjacent the head of the pointer 73 when it comes to rest.

Although the invention has hereinbefore been described with particular reference to the embodiments thereof as shown in the accompanying drawings, it will be understood that numerous modifications and variations other than those hereinbefore specifically mentioned are possible.

What is claimed is:

1. A game apparatus which comprises:

a playing board having provided thereon a track divided into a sequence of playing zones, alphabetical characters randomly selected from a set of such characters being provided on said board in association with respective ones of said playing zones;

a playing piece for movement by a player along said track; and a die bearing only numerical characters upwardly consecutive from a character representing the cardinal number 2 for randomly indicating the number of zones of said track over which said playing piece should be moved by the player and for indicating the number of letters in a word to be formed by the player.

2. A game apparatus which comprises:

a playing board having provided thereon a track divided into a sequence of playing zones, numerical characters randomly selected from a set of such characters being provided on said board in association with respective ones of said playing zones;

a playing piece for movement by a player along said track;

first indicating means for randomly indicating the number of zones of said track over which said playing piece should be moved by the player; and a second indicating means comprising a deck of cards, each bearing a sequence of alphabetical characters and, spaced apart from said sequence, an alphabetical character randomly selected from such a sequence.

3. A game apparatus which comprises:

a playing board having provided thereon a track divided into a sequence of playing zones, alphabetical characters being provided on said board in association with respective ones of said playing zones;

a playing piece for movement by a player along said track;

first indicating means for randomly indicating the number of zones of said track over which said playing piece should be moved by the player; and a second indicating means comprising a deck of cards each carrying on a normally hidden face thereof a numerical character.

* * * * *